US011850205B2

(12) United States Patent
Jolly et al.

(10) Patent No.: US 11,850,205 B2
(45) Date of Patent: Dec. 26, 2023

(54) METHODS OF VIBRATIONALLY EXCITING A LARYNGEAL NERVE

(71) Applicant: Passy-Muir, Inc., Irvine, CA (US)

(72) Inventors: Alex Jolly, Newport Beach, CA (US); Cameron Jolly, Newport, CA (US); Kristin King, Littleton, NC (US); Jose Comino, Irvine, CA (US); Daniel Carrillo, Irvine, CA (US); Wayne Fong, Irvine, CA (US); Kenneth Green, La Habra Heights, CA (US)

(73) Assignee: Passy-Muir, Inc., Irvine, CA (US)

( * ) Notice: Subject to any disclaimer, the term of this patent is extended or adjusted under 35 U.S.C. 154(b) by 0 days.

(21) Appl. No.: 17/887,299

(22) Filed: Aug. 12, 2022

(65) Prior Publication Data

US 2022/0378650 A1 Dec. 1, 2022

Related U.S. Application Data

(63) Continuation of application No. 17/305,282, filed on Jul. 2, 2021, now Pat. No. 11,413,214, which is a (Continued)

(51) Int. Cl.
*A61H 23/02* (2006.01)

(52) U.S. Cl.
CPC ..... *A61H 23/02* (2013.01); *A61H 2201/165* (2013.01); *A61H 2201/1611* (2013.01); (Continued)

(58) Field of Classification Search
CPC ..... A61H 23/02; A61H 2201/1611; A61H 2201/165; A61H 2201/501; A61H 2201/5071; A61H 2205/04
(Continued)

(56) References Cited

U.S. PATENT DOCUMENTS 4,143,648 A 3/1979 Cohen et al.
4,685,448 A 8/1987 Shames et al.
(Continued)

FOREIGN PATENT DOCUMENTS

AU 2006265985 3/2011
AU 2011201177 4/2011
(Continued)

OTHER PUBLICATIONS

Andersen et al., Modulation of heat evoked nociceptive withdrawal reflexes by painful intramuscular conditioning stimulation, Exp Brain Res, 2006, vol. 174, pp. 755-780.
(Continued)

*Primary Examiner* — Valerie L Woodward
*Assistant Examiner* — Paige Kathleen Bugg
(74) *Attorney, Agent, or Firm* — Knobbe Martens Olson & Bear LLP

(57) ABSTRACT

A laryngeal nerve exciting system includes a collar holding a bridge, or a neckband, pressing soft tissue nerve exciters against a patient's neck providing a source of vibrations to stimulate the laryngeal nerve through the larynx. At least one exciter, and preferably two exciters, provide vibrations at preferably 70 Hz to 110 Hz and sufficiently strong to penetrate to the laryngeal nerve. The exciters may be held by the collar circling the neck, or by the neck band partially circling the neck. The therapy system includes a Personal Digital Assistant (PDA) and software which wirelessly connects, monitors, and triggers the device. The system may be used to treat dysphagia, chronic cough, and spasmodic dysphonia.

13 Claims, 7 Drawing Sheets

Related U.S. Application Data continuation of application No. 16/853,477, filed on Apr. 20, 2020, now abandoned.

(60) Provisional application No. 62/836,195, filed on Apr. 19, 2019.

(52) U.S. Cl.
CPC ..... *A61H 2201/501* (2013.01); *A61H 2201/5071* (2013.01); *A61H 2205/04* (2013.01)

(58) Field of Classification Search
USPC ..... 601/79
See application file for complete search history.

(56) References Cited

U.S. PATENT DOCUMENTS

| | | | | |
|---|---|---|---|---|
| 5,007,410 | A | 4/1991 | DeLaney | |
| 5,086,788 | A | 2/1992 | Castel et al. | |
| 5,111,814 | A | 5/1992 | Goldfarb | |
| 5,350,407 | A | 9/1994 | McClure et al. | |
| 5,562,718 | A | 10/1996 | Palermo | |
| 5,611,771 | A | 3/1997 | Taylor | |
| 5,725,564 | A | 3/1998 | Freed et al. | |
| 5,871,508 | A | 2/1999 | Thompson et al. | |
| 5,891,185 | A | 4/1999 | Freed et al. | |
| 5,897,579 | A | 4/1999 | Sanders | |
| 5,987,359 | A | 11/1999 | Freed et al. | |
| 6,039,679 | A | 3/2000 | Yu | |
| 6,104,958 | A | 8/2000 | Freed et al. | |
| 6,131,535 | A | 10/2000 | So | |
| 6,198,970 | B1 | 3/2001 | Freed et al. | |
| 6,343,232 | B1 | 1/2002 | Mower | |
| 6,354,991 | B1 | 3/2002 | Gross et al. | |
| 6,393,323 | B1 | 5/2002 | Sawan et al. | |
| 6,484,053 | B2 | 11/2002 | Leelamanit et al. | |
| 6,735,315 | B1 | 5/2004 | Ifukube et al. | |
| 7,039,468 | B2 | 5/2006 | Freed et al. | |
| 7,182,738 | B2 | 2/2007 | Bonutti et al. | |
| 7,254,444 | B2 | 8/2007 | Moore et al. | |
| 7,280,873 | B2 | 10/2007 | Freed et al. | |
| 7,349,739 | B2 | 3/2008 | Harry et al. | |
| 7,582,066 | B2 | 9/2009 | Shimotori | |
| 7,606,623 | B2 | 10/2009 | Ludlow et al. | |
| 7,660,636 | B2 | 2/2010 | Castel et al. | |
| 8,388,561 | B2 | 3/2013 | Ludlow et al. | |
| 8,449,445 | B2 | 5/2013 | Ludlow et al. | |
| 8,579,839 | B2 | 11/2013 | Ludlow et al. | |
| 8,808,207 | B2 | 8/2014 | Ludlow et al. | |
| 8,852,074 | B2 | 10/2014 | Ludlow et al. | |
| 10,071,016 | B2 | 9/2018 | Ludlow et al. | |
| 11,229,576 | B2 | 1/2022 | Jolly et al. | |
| 11,344,471 | B2 | 5/2022 | Ludlow et al. | |
| 11,419,784 | B2 | 8/2022 | Jolly et al. | |
| 2002/0010495 | A1 | 1/2002 | Freed et al. | |
| 2002/0049479 | A1 | 4/2002 | Pitts | |
| 2002/0133194 | A1 | 9/2002 | Leelamanit et al. | |
| 2003/0093128 | A1 | 5/2003 | Freed et al. | |
| 2004/0073271 | A1 | 4/2004 | Harry et al. | |
| 2004/0133133 | A1 | 7/2004 | Dreimann et al. | |
| 2004/0249320 | A1 | 12/2004 | Yamazaki et al. | |
| 2004/0267331 | A1 | 12/2004 | Koeneman et al. | |
| 2005/0049453 | A1 | 3/2005 | Faulkner | |
| 2005/0049856 | A1* | 3/2005 | Baraff | G10L 21/0208 704/219 |
| 2005/0059909 | A1 | 3/2005 | Burgess | |
| 2005/0267388 | A1 | 12/2005 | Hanna | |
| 2006/0030794 | A1 | 2/2006 | Nation et al. | |
| 2007/0073361 | A1 | 3/2007 | Goren et al. | |
| 2007/0123950 | A1 | 5/2007 | Ludlow et al. | |
| 2007/0293926 | A1 | 12/2007 | Dunlay et al. | |
| 2008/0077192 | A1 | 3/2008 | Harry et al. | |
| 2008/0195006 | A1 | 8/2008 | Stark | |
| 2009/0048645 | A1 | 2/2009 | Philipp et al. | |
| 2009/0054980 | A1 | 2/2009 | Ludlow et al. | |
| 2009/0187124 | A1* | 7/2009 | Ludlow | A61H 23/00 601/47 |
| 2010/0016908 | A1 | 1/2010 | Martin et al. | |
| 2010/0049103 | A1* | 2/2010 | Ludlow | A61H 39/00 601/84 |
| 2010/0241191 | A1 | 9/2010 | Testerman et al. | |
| 2011/0125212 | A1 | 5/2011 | Tyler | |
| 2012/0046579 | A1 | 2/2012 | Radl et al. | |
| 2012/0184883 | A1* | 7/2012 | Song | A61H 23/02 601/46 |
| 2012/0296243 | A1 | 11/2012 | Ludlow et al. | |
| 2012/0302929 | A1* | 11/2012 | Tkachenko | A61H 23/0254 601/48 |
| 2013/0072834 | A1* | 3/2013 | Afshar | A61H 23/0263 601/46 |
| 2013/0102937 | A1 | 4/2013 | Ehrenreich et al. | |
| 2014/0276270 | A1* | 9/2014 | Ludlow | A61N 5/0622 601/46 |
| 2017/0007497 | A1* | 1/2017 | Ludlow | G09B 19/04 |
| 2017/0165101 | A1 | 6/2017 | Davidian | |
| 2018/0233225 | A1* | 8/2018 | Experton | G16H 10/60 |
| 2019/0053968 | A1* | 2/2019 | Vergara | A61H 23/02 |
| 2019/0151604 | A1* | 5/2019 | Harper | A61H 23/02 |
| 2019/0159953 | A1* | 5/2019 | Konczak | A61H 1/005 |
| 2019/0262212 | A1* | 8/2019 | Schroeder | A61H 1/0296 |
| 2019/0262225 | A1 | 8/2019 | Gertner et al. | |
| 2020/0330323 | A1 | 10/2020 | Jolly et al. | |
| 2021/0322261 | A1 | 10/2021 | Jolly et al. | |
| 2021/0322262 | A1 | 10/2021 | Jolly et al. | |
| 2021/0322263 | A1 | 10/2021 | Jolly et al. | |
| 2022/0313543 | A1 | 10/2022 | Ludlow et al. | |

FOREIGN PATENT DOCUMENTS

| | | | | |
|---|---|---|---|---|
| CA | 2614072 | | 1/2019 | |
| CN | 101716394 | | 6/2010 | |
| EP | 0 226 333 | A1 | 6/1987 | |
| EP | 1917067 | | 1/2007 | |
| EP | 2334278 | | 6/2011 | |
| HK | 1117439 | | 1/2009 | |
| JP | 62-174788 | A | 7/1987 | |
| JP | S64-046459 | | 2/1989 | |
| JP | H06-190017 | | 7/1994 | |
| JP | H09-084845 | | 3/1997 | |
| JP | 11-500339 | | 1/1999 | |
| JP | 2003-111748 | | 4/2003 | |
| JP | 2006-500994 | | 1/2006 | |
| JP | 2007-151736 | | 6/2007 | |
| JP | 2008-520306 | | 6/2008 | |
| JP | 2008-544832 | | 12/2008 | |
| WO | WO 92/21407 | | 12/1992 | |
| WO | WO 97/15349 | | 5/1997 | |
| WO | WO 2004/028433 | | 4/2004 | |
| WO | WO 2006/054118 | A1 | 5/2006 | |
| WO | WO 2007/005582 | | 1/2007 | |
| WO | WO 2007/123746 | | 11/2007 | |
| WO | WO 2010/033594 | | 3/2010 | |
| WO | WO 2016/001393 | | 1/2016 | |
| WO | WO-2016001393 | A1 * | 1/2016 | A61B 5/04087 |

OTHER PUBLICATIONS

Aviv et al., "Laryngopharyngeal sensory testing with modified barium swallow as predictors of aspiration pneumonia after stroke", Laryngoscope, 107:1254-1260 (1997).

Aviv et al., "Silent laryngopharyngeal sensory deficits after stroke", Ann Otol Rhinol. Laryngol., 106:87-93 (1997).

Aviv et al., "Supraglottic and pharyngeal sensory abnormalities in stroke patients with dysphagia", Ann Otol Rhinol.Laryngol., 105:92-97 (1996).

Bara-Jimenez et al., "Abnormal somatosensory homunculus in dystonia of the hand", Ann Neurol., 44(5):828-831 (1998).

Bara-Jimenez et al., "Sensory discrimination capabilities in patients with focal hand dystonia", Ann Neural., 47(3):377-380 (2000).

Bhadra et al., Extraction Force and Tissue Change During Removal of a Tined Intramuscular Electrode from Rat Gastrocnemius, Annals

(56) References Cited

OTHER PUBLICATIONS of Biomedical Engineering, Jun. 2006, vol. 34, Issue No. 6, pp. 1042-1050.
Bidus et al., "Effects of Adductor Muscle Stimulation on Speech in Abductor Spasmodic Cysphonia", The Laryngoscope, 110:1943-1949 (2000).
Bielamowicz et al., "Effects of botulinum toxin on pathophysiology in spasmodic dysphonia", Ann Otol Rhinol Laryngol, 109: 194-203 (2000).
Burnett et al., "Laryngeal elevation achieved by neuromuscular stimulation at rest", J Appl Physiol, 94(1): 128-134 (2003).
Burnett et al., "Self-Triggered Functional Electrical Stimulation During Swallowing", J Neurophysiol, 94(6):4011-4018 (2005).
Caetano et al., Evidence of vibrotactile input to human auditory cortex, NeuroImage, 2006, vol. 29, pp. 15-28.
Celichowski et al., The time course of the last contractions during incompletely fused tetani of motor units in rat skeletal muscle, Acta Neurobiol. Exp., 2002, vol. 62, pp. 7-17.
Chou et al., Predicting optimal electrical stimulation for repetitive human muscle activation, Journal of Electromyography and Kinesiology, 2005, vol. 15, pp. 300-309.
Conforto et al., "Increase in hand muscle strength of stroke patients after somatosensory stimulation", Ann Neurol, 51(1): 122-125 (2002).
Daly et al., "Performance of an intramuscular electrode during functional neuromuscular stimulation for gait training post stroke", Journal of Rehabilitation Research and Development, 38(5):513-526 (2001).
Davis et al., Quantitative analysis of laryngeal mechanosensitivity in the cat and rabbit, J. Physiol., 1987, vol. 388, pp. 467-485.
De Larminat et al., "Alteration in swallowing reflex after extubation in intensive care unit patients", Crit Care Med, 23(3):486-490 (1995).
De Nil et al., "Kinaesthetic acuity of stutterers and non-stutterers for oral and non-oral movements", Brain, 114:2145-2158 (1991).
Decision of Rejection issued in Japanese Patent Application No. 2011-527935, dated Jan. 21, 2014.
Decision of Rejection issued in Japanese Patent Application No. 2013-025371, dated Oct. 20, 2014.
Dick et al., "Interaction between central pattern generators for breathing and swallowing in the cat", J Physiol, 465:715-730 (1993).
Experia™: The Next Generation of VitalStim® Therapy brochure, 2007 Encore Medical, L.P. and Affiliates, 2 pages.
Extended European Search Report for European Patent Application No. 11005014.3 dated Sep. 30, 2011.
Final Office Action in Japanese Application No. 2008-520302, dated Aug. 14, 2012.
Final Office Action issued in U.S. Appl. No. 11/993,094, dated Oct. 16, 2012.
Final Office Action issued in U.S. Appl. No. 12/211,633, dated Sep. 17, 2012.
Final Office Action issued in U.S. Appl. No. 12/240,398, dated Jun. 21, 2012.
Final Office Action issued in U.S. Appl. No. 13/492,044, dated Jun. 4, 2013.
Final Office Action issued in U.S. Appl. No. 13/492,044, dated May 2, 2014.
Final Office Action issued in U.S. Appl. No. 13/799,549, dated Jun. 8, 2016.
Final Office Action issued in U.S. Appl. No. 14/471,369, dated Apr. 6, 2017.
Final Office Action issued in U.S. Appl. No. 13/777,907, dated Mar. 26, 2014.
First Action Interview Pilot Program Pre-Interview Communication issued in U.S. Appl. No. 13/492,044, dated Oct. 18, 2012.
Folstein et al., "Mini-mental state. A practical method for grading the cognitive state of patients for the clinician", J Psychiatr Res, 12(3):189-198 (1975).
Fraser et al., "Differential changes in human pharyngoesophageal motor excitability induced by swallowing, pharyngeal stimulation, and anesthesia", Am J Physiol Gastrointest Liver Physiol, 285(1):G137-144 (2003).
Freed et al., "Electrical Stimulation for Swallowing Disorders Caused by Stroke", Respiratory Care, 46(5):466-474 (2001).
Grottel et al., The Influence of changes in the stimulation pattern on force and fusion in motor units of the rat medial gastrocnemius muscle, Exp Brain Res, 1999, vol. 127, pp. 298-306.
Hägg et al., "Effects of motor and sensory stimulation in stroke patients with long-lasting dysphagia", Dysphagia, 19:219-230 (2004).
Hamdy et al., "Modulation of human swallowing behaviour by thermal and chemical stimulation in health and after brain injury", Neurogastroenterol Motil, 15(1):69-77 (2003).
Handa et al., "Development of Percutaneous Intramuscular Electrode for Multichannel FES System", IEEE Transactions on Biomedical Engineering, 36(7):705-710.
Haslinger et al., "Silent event-related fMRI reveals reduced sensorimotor activation in laryngeal dystonia", Neurology, 65:1562-1569 (2005).
Hrycyshyn et al., "Electromyography of the Oral Stage of Swallowing in Man", Am. J. Anat., 133:333-340 (1972).
Humbert et al., "The effect of surface electrical stimulation on hyolaryngeal movement in normal individuals at rest and during swallowing", J Appl Physiol, 101:1657-1663 (2006).
Humbert et al., The Effect of Surface Electrical Stimulation on Vocal Fold Posiiton, The Laryngoscope, Jan. 2008, vol. 118, pp. 14-19.
International Preliminary Report on Patentability and Written Opinion of the International Searching Authority for International Application No. PCT/US2006/025535, dated Jan. 9, 2008.
International Preliminary Report on Patentability and Written Opinion of the International Searching Authority for International Application No. PCT/US2007/007993, dated Sep. 30, 2008.
International Preliminary Report on Patentability and Written Opinion of the International Searching Authority for International Application No. PCT/US2009/057158, dated Mar. 22, 2011.
International Search Report and Written Opinion of the International Searching Authority for International Application No. PCT/US2006/025535, dated Nov. 21, 2006.
International Search Report and Written Opinion of the International Searching Authority for International Application No. PCT/US2007/007993, dated Mar. 5, 2008.
International Search Report for International Application No. PCT/US03/30032 dated Apr. 9, 2004.
International Search Report for International Application No. PCT/US2009/057158, dated Mar. 26, 2010.
International Search Report for International Application No. PCT/US2014/014208 dated Jun. 26, 2014.
Jafari et al., "Sensory regulation of swallowing and airway protection: a role for the internal superior laryngeal nerve in humans", J Physiol, 550(Pt I):287-304 (2003).
Jean, "Control of the central swallowing program by inputs from the peripheral receptors. A review", J Auton. Ner. Syst., 10:225-233 (1984).
Jean, Brain Stem Control of Swollowing: Neuronal Network and Cellular Mechanisms, Physiological Reviews, Apr. 2001, vol. 81, Issue No. 2, pp. 929-969.
Kamarunas et al., "Vibration overlying the larynx increases swallowing in chronic oropharyngeal dysphagia," Original Research, pp. 1-41, Jul. 17, 2017.
Kesar et al., Effect of frequency and pulse duration on human muscle fatigue during repetitive electrical stimulation, Exp Physiol, 2006, vol. 91, Issue No. 6, pp. 967-976.
Kimberley et al., "Electrical stimulation driving functional improvements and cortical changes in subjects with stroke", Experimental Brain Research, 2004, vol. 154, pp. 450-460.
Kitagawa et al., Facilitation of reflex swallowing from the pharynx and larynx, Journal of Oral Science, 2009, vol. 51, Issue No. 2, pp. 167-171.
Knutson et al., Electrode fracture rates and occurrences of infection and granuloma associated with percutaneous intramuscular elec-

(56) References Cited

OTHER PUBLICATIONS trodes in upper-limb functional electrical stimulation applications, Journal of Rehabilitation Research and Development, 2002, vol. 39, Issue No. 6, pp. 671-683.
Leelamanit et al., "Synchronized electrical stimulation in treating pharyngeal dysphagia", Laryngoscope, 112(12):2204-2210 (2002).
Logemann et al., "Effects of a sour bolus on oropharyngeal swallowing measures in patients with neurogenic dysphagia", J Speech Hear Res, 38(3):556-563 (1995).
Logemann, "Noninvasive approaches to deglutitive aspiration", Dysphagia, 8(4):331-333 (1993).
Loucks et al., "Laryngeal muscle responses to mechanical displacement of the thyroid cartilage in humans", J Appl Physiol, 99(3):922-930 (2005).
Lowell et al., "Sensory stimulation activates both motor and sensory components of the swallowing system", NeuroImage, 42:285-295 (2008).
Ludlow et al., "Chronic Intermittent Stimulation of the Thyroarytenoid Muscle Maintains Dynamic Control of Glottal Adduction", Muscle and Nerve, 23:44-57 (2000).
Ludlow et al., "Dynamic aspects of phonatory control in spasmodic dysphonia", J Speech Hear Res, 30:197-206 (1987).
Ludlow et al., "Effects of Surface Electrical Stimulation Both at Rest and During Swallowing in Chronic Pharyngeal Dysphagia", Dysphagia, 22:1-10 (2007).
Ludlow et al., "Three-Dimensional Changes in the Upper Airway During Neuromuscular Stimulation of Laryngeal Muscles", Journal of Artificial Organs, 23:463-465 (1999).
Lundy et al., "Aspiration: Cause and Implications", Otolaryngol Head Neck Surg., 120(4):474-478 (1999).
Marsolais et al., "Implantation techniques and experience with percutaneous intramuscular electrodes in the lower extremities", J. Rehabil. Res. Dev., 23(3):1-8 (1986).
Mifflin, "Intensity and frequency dependence of laryngeal afferent inputs to respiratory hypoglossal motoneurons", J.Appl Physiol, 83:1890-1899 (1997).
Mortimer et al., "Intramuscular Electrical Stimulation: Tissue Damage", Ann. Biomed. Eng., 8:235-244 (1980).
Mortimer et al., Vibrotactile transduction and transducers, J. Acoust. Soc. Am., May 2007, vol. 121, Issue No. 5, pp. 2970-2977.
Mulheren et al., "Vibration over the larynx increases swallowing and cortical activation for swallowing", J. Neurophysiol., 118: 169-1708, Jul. 5, 2017.
Nishino et al., "Cough and other reflexes on irritation of airway mucosa in man", Pulm Pharmacol, 9(5-6):285-292 (1996).
Notice of Acceptance issued in Australian Application No. 2011201177, dated Mar. 12, 2013.
Notice of Acceptance issued in Australian Patent Application No. 2006265985 dated Dec. 1, 2010.
Notice of Acceptance issued in Australian Patent Application No. 2009293277, dated Feb. 25, 2014.
Notice of Allowance issued in Japanese Application No. 2008-520302, dated Aug. 6, 2013.
Notice of Allowance issued in U.S. Appl. No. 11/993,094, dated Jun. 27, 2013.
Notice of Allowance issued in U.S. Appl. No. 12/211,633, dated Oct. 30, 2012.
Notice of Allowance issued in U.S. Appl. No. 12/240,398, dated Feb. 1, 2013.
Notice of Allowance issued in U.S. Appl. No. 13/777,907, dated Apr. 11, 2014.
Notice of Allowance issued in U.S. Appl. No. 13/902,263, dated Jun. 6, 2014.
Notice of Allowance issued in U.S. Appl. No. 17/305,268, dated Oct. 18, 2021.
Notice of Panel Decision from Pre-Appeal Brief Review issued in U.S. Appl. No. 13/492,044, dated Nov. 15, 2013.
Office Action in Australian Patent Application No. 2011201177, dated Aug. 1, 2012.
Office Action issued in Australian Patent Application No. 2006265985 dated Oct. 20, 2009.
Office Action issued in Australian Patent Application No. 2011201177, dated Feb. 23, 2012.
Office Action issued in Canadian Patent Application No. 2,614,072, dated Mar. 12, 2014.
Office Action issued in Canadian Patent Application No. 2,614,072, dated Jan. 26, 2016.
Office Action issued in Canadian Patent Application No. 2,737,478, dated Sep. 30, 2016.
Office Action issued in EP Application No. 11 005 014.3, dated Jun. 8, 2012.
Office Action issued in European Patent Application No. 06785933.0 dated Feb. 10, 2011.
Office Action issued in Japanese Application No. 2011-527935, dated Jan. 15, 2013.
Office Action issued in Japanese Application No. 2011-527935, dated Jul. 16, 2013.
Office Action issued in Japanese Patent Application No. 2008-520302 dated Nov. 15, 2011.
Office Action issued in Japanese Patent Application No. 2013-025371, dated Feb. 10, 2014.
Office Action issued in U.S. Appl. No. 11/993,094, dated Feb. 4, 2013.
Office Action issued in U.S. Appl. No. 13/492,044, dated Dec. 4, 2013.
Office Action issued in U.S. Appl. No. 13/777,907, dated Oct. 25, 2013.
Office Action issued in U.S. Appl. No. 13/799,549, dated Sep. 17, 2015.
Office Action issued in U.S. Appl. No. 13/902,263, dated Feb. 12, 2014.
Office Action issued in U.S. Appl. No. 11/993,094, dated Mar. 13, 2012.
Office Action issued in U.S. Appl. No. 12/211,633, dated Jan. 4, 2012.
Office Action issued in U.S. Appl. No. 12/240,398, dated Dec. 28, 2011.
Office Action issued in U.S. Appl. No. 14/471,369, dated Sep. 9, 2016.
Office Action issued in U.S. Appl. No. 17/305,280, dated Sep. 28, 2021.
Ootani et al., "Convergence of afferents from the SLN and GPN in cat medullary swallowing neurons", Brain Res Bull, 37(4):397-404 (1995).
Park et al., "A pilot exploratory study of oral electrical stimulation on swallow function following stroke: an innovative technique", Dysphagia, 12(3):161-166 (1997).
Patent Examination Report issued in Australian Application No. AU2009293277, dated Jun. 7, 2013.
Pertovaara, Modification of human pain threshold by specific tactile receptors, Acta Physiol Scand, 1979, vol. 107, pp. 339-341.
Peurala et al., "Cutaneous electrical stimulation may enhance sensorimotor recovery in chronic stroke", Clin Rehabil., 16:709-716 (2002).
Pick et al., "Pulmonary aspiration in a long-term care setting: clinical and laboratory observations and an analysis of risk factors", J Am Geriatr Soc, 44(7):763-768 (1996).
Pommerenke, "A study of the sensory areas eliciting the swallowing reflex", American Journal of Physiology, 84(1):36-41 (1927).
Portone et al., "A review of patient adherence to the recommendations for voice therapy", J. Voice, 22:192-196 (2008).
Power et al., "Changes in pharyngeal corticobulbar excitability and swallowing behavior after oral stimulation", Am J Physiol Gastrointest Liver Physiol, 286(1):G45-50 (2004).
Power et al., "Evaluating oral stimulation as a treatment for Dysphagia after stroke", Dysphagia, 21(1):49-55 (2006).
Restriction Requirement issued in U.S. Appl. No. 13/902,263, dated Oct. 11, 2013.
Restriction Requirement issued in U.S. Appl. No. 11/993,094 dated Jan. 24, 2012.
Restriction Requirement issued in U.S. Appl. No. 12/240,398 dated Nov. 23, 2011.

(56) References Cited

OTHER PUBLICATIONS

Robbins et al., "Swallowing and dysphagia rehabilitation: translating principles of neural plasticity into clinically orientated evidence", J Speech Lang. Hear. Res., 51:S276-300 (2008).
Scheiner et al., "Design and Clinical Application of a Double Helix Electrode for Functional Electrical Stimulation", IEEE Transactions of Biomedical Engineering, 41(5):425-431 (1994).
Sedory-Holzer et al., "The swallowing side effects of botulinum toxin type A injection in spasmodic dysphonia", Laryngoscope, 106:86-92 (1996).
Setzen et al., "The association between laryngopharyngeal sensory deficits, pharyngeal motor function, and the prevalence of aspiration with thin liquids", Otolaryngol Head Neck Surg, 128(1):99-102 (2003).
Spiro et al., "Activation and Coordination Patterns of the Suprahyoid Muscles During Swallowing", Laryngoscope, 104:1376-1382 (1994).
Stanic et al., "Multichannel Electrical Stimulation for Correction of Hemiplegic Gait", Scand J. Rehabil. Med., 10:75-92 (1978).
Strojnik et al., "Treatment of Drop Foot Using an Implantable Peroneal Underknee Stimulator", Scand J. Rehabil. Med., 19:37-43 (1987).
Struppler et al., "Modulation of sensorimotor performances and cognition abilities induced by RPMS: clinical and experimental investigations", Suppl Clin Neurophysiol., 56:358-367 (2003).
Sundgren et al., "Elevation of the larynx on normal and abnormal cineradiogram", The British Journal of Radiology, 66:768-772(1993).
Supplementary European Search Report for European Application No. 03776191.3 dated May 14, 2008.
Theurer et al., "Oropharyngeal stimulation with air-pulse trains increases swallowing frequency in healthy adults", Dysphagia, 20(4):254-260 (2005).
Van Dijk et al., "Effects of transcutaneous electrical nerve stimulation (TENS) on non-pain related cognitive and behavioural functioning", Rev Neurosci., 13:257-270 (2002).
Wakeling et al., Muscle activity damps the soft tissue resonance that occurs in response to pulsed and continuous vibrations, J Appl Physiol, May 17, 2002, vol. 93, pp. 1093-1103.
Waters et al., "Functional Electrical Stimulation of the Peroneal Nerve for Hemiplegia", The Journal of Bone and Joint Surgery, 67:792-793 (1985).
Witteveen et al., Vibro- and Electrotactile User Feedback on Hand Opening for Myoelectric Forearm Prostheses, IEEE Transactions on Biomedical Engineering, Aug. 2012, vol. 59, Issue No. 8, pp. 2219-2226.
Final Office Action dated Dec. 17, 2021 in U.S. Appl. No. 17/305,280.
Notice of Allowance dated Apr. 7, 2022 in U.S. Appl. No. 17/305,280.
Office Action dated Sep. 14, 2021 in U.S. Appl. No. 17/305,282.
Final Office Action dated Dec. 16, 2021 in U.S. Appl. No. 17/305,282.
Notice of Allowance dated Jul. 15, 2022 in U.S. Appl. No. 17/305,282.
Office Action dated Sep. 11, 2020 in U.S. Appl. No. 16/853,477, in 16 pages.
Final Office Action dated Mar. 25, 2021 in U.S. Appl. No. 16/853,477, in 34 pages.
Office Action dated Mar. 14, 2023 in U.S. Appl. No. 17/660,381.

* cited by examiner

METHODS OF VIBRATIONALLY EXCITING A LARYNGEAL NERVE

CROSS-REFERENCE TO RELATED APPLICATIONS

The application is a continuation of U.S. patent application Ser. No. 17/305,282, filed Jul. 2, 2021, which is a continuation of U.S. patent application Ser. No. 16/853,477, filed Apr. 20, 2020, now abandoned, which claims the priority of U.S. Provisional Patent Application No. 62/836,195, filed Apr. 19, 2019, the disclosures of each of which is incorporated in its entirety herein by reference.

BACKGROUND

The present invention relates to human tissue stimulation and in particular to noninvasive vibration on the neck overlying the larynx to excite the laryngeal nerve to augment or reestablish swallowing control during rehabilitation of patients with dysphagia, and to treat voice disorders affecting the function of the laryngeal system, such as spasmodic dysphonia, and to treat chronic cough.

Dysphagia is a major swallowing disorder that effects the central nervous system, and the peripheral nervous system, thereby weakening neuromuscular control and effectively reducing the ability to properly swallow. Dysphagia may occur at any time across the lifespan. This impairment has many potential causes, including but not limited to neurologic disorders, degenerative disease processes, and anatomical changes. Dysphagia is characterized by difficulty swallowing, impaired ability to protect the airway during swallowing (penetration and aspiration), and impaired ability to transport a bolus of food or liquid from the mouth to the stomach. These difficulties may contribute to a risk for respiratory complications (pneumonia), dehydration, malnutrition, and may restrict social eating. Because of these negative impacts, it also may significantly impact quality of life for an individual.

An occasional cough is normal in that it helps to clear irritants and secretions from the lungs; however, when a cough lasts longer than eight weeks in adults and begins to interfere with daily functions, such as sleep and bladder control, then it may be diagnosed as a chronic cough. In children, this diagnosis may occur after four weeks of coughing. Chronic cough occurs in the upper airway of the respiratory system, and the condition may be caused by co-morbidities, such as asthma, post-nasal drip, or reflux. However, the mechanism is unknown. The cough reflex may be impaired by a disease condition that weakens the cough which could lead to muscle weakness or paralysis, or it may be secondary to laryngeal nerve involvement.

Spasmodic dysphonia is a disorder that may occur with neurological disorders or disease processes that impact laryngeal function and muscles of the voice. This disorder of the laryngeal system causes the muscles involved in voicing to periodically spasm, triggering increased tension and a distortion of the voice. The spasms cause interruptions and breaks in the voice. Causes of spasmodic dysphonia are unknown but may relate to such processes as anxiety, infection, or direct injury to the larynx. It is more common in women and occurs most often between the ages of 30-50 years.

Any neurologic disease or process that impacts laryngeal function may negatively impact swallowing, voicing, and airway functions such as cough and throat clear, or any function that originates within or requires function of the laryngeal system. Various functions within the laryngeal system occur due to stimulation of the afferent pathways which transmit impulses to the brain and are then interpreted for communication with the efferent system for movement. Current treatment for an impairment or changes of laryngeal function that is caused by various neurological disorders or laryngeal injury are typically long-term behavioral therapy or invasive treatment with the injection of foreign materials or medications into the muscles, nerves, or tissues of the larynx. However, various disorders, such as dysphagia, chronic cough, and voicing disorders, may be improved by innervation of the afferent system within the larynx including the branches of the vagus nerve, such as the recurrent laryngeal, superior laryngeal, and pharyngeal branches, and vibration is known to relax muscles and to provide stimulation to tissues being innervated offering an alternative treatment.

U.S. Pat. No. 8,388,561 describes a vibrotactile stimulator having a band 101 worn around a patient's neck and including a vibrator 102 positionable over the larynx to provide stimulation generally centered on the patient's neck. The vibrator 102 is an electric motor spinning an offset weight. While the '561 patent provides a potential method for addressing dysphagia, there remains a need for improved dysphagia therapy devices.

SUMMARY

The present invention addresses the above and other needs by providing a vibrating laryngeal nerve exciting device which includes a collar holding a bridge, or a neckband, pressing soft tissue nerve exciters against a patient's neck providing a source of vibrations to stimulate the branches of the vagus nerve, such as the recurrent laryngeal, superior laryngeal, and pharyngeal branches. At least one exciter, and preferably two exciters, provide vibrations preferably adjustable between 30 Hz and 200 Hz and more preferably between 70 and 110 Hz and sufficiently strong to penetrate to the laryngeal nerve, for example, a pressure of 2-4 kpa or a vibration amplitude of 0.15 mm to 0.25 mm. The exciters may be held by the collar circling the neck, or by the neck band partially circling the neck. The therapy system includes a Personal Digital Assistant (PDA) device and software which wirelessly connects, monitors, and triggers the device. The system may be used to treat dysphagia, chronic cough, and spasmodic dysphonia.

In accordance with one aspect of the invention, there is provided software (e.g., a smartphone application) which wirelessly connects and triggers the device, for example, through a Bluetooth® protocol. The software sets the frequency of the device, intensity, therapy time, vibration time, duration of rest period between vibration, and allows for patients to provide feedback about the therapy. A general state of health section allows the patient to diary how the patient is feeling before and after the therapy. The software allows clinicians to monitor the patient's progress. The clinician can see the device settings (frequency of the device, intensity, therapy time, vibration time, duration of rest period between vibration), number of uses, whether therapy was completed, and the patient's feedback diary.

BRIEF DESCRIPTION OF THE DRAWINGS

The above and other aspects, features and advantages of the present invention will be more apparent from the following more particular description thereof, presented in conjunction with the following drawings.

Corresponding reference characters indicate corresponding components throughout the several views of the drawings.

DETAILED DESCRIPTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1C:
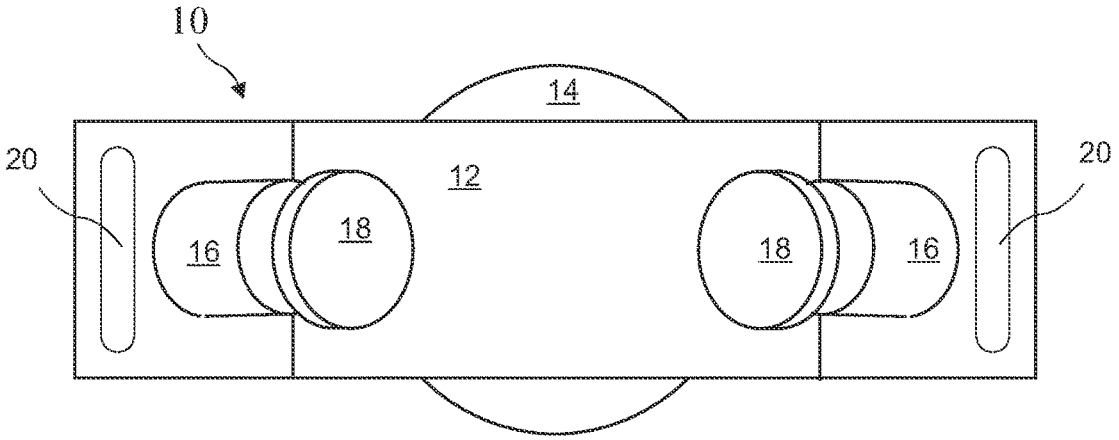
FIG. 1C shows a rear view of the laryngeal nerve exciter according to the present invention.
Figure 1B:
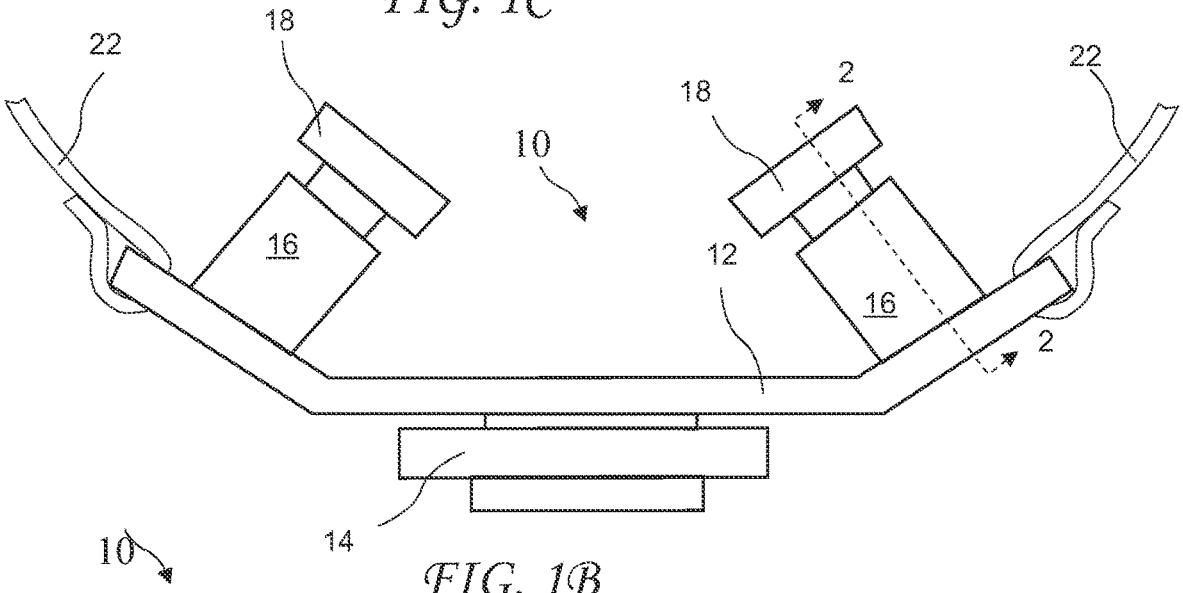
FIG. 1B shows a top view of the laryngeal nerve exciter according to the present invention.
Figure 1A:
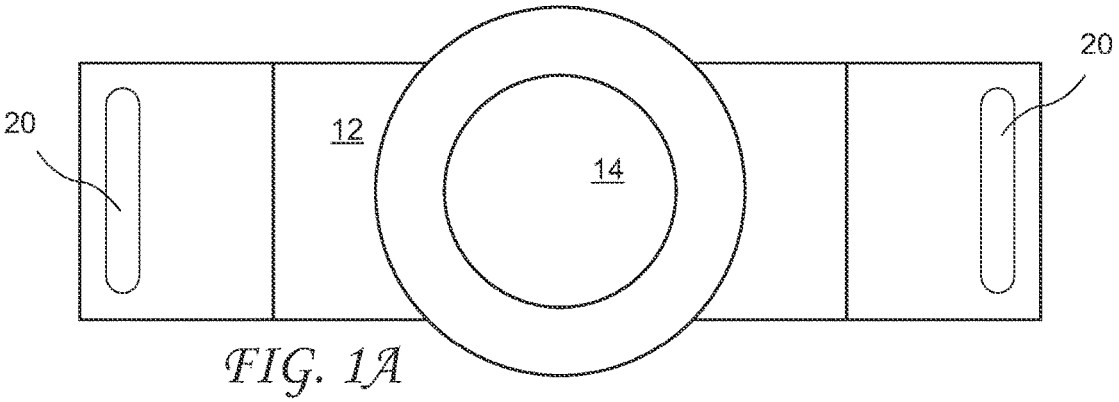
FIG. 1A shows a front view of a laryngeal nerve exciter according to the present invention.

A front view of a laryngeal nerve exciter 10 according to the present invention is shown in FIG. 1*a*, a top view of the laryngeal nerve exciter 10 is shown in FIG. 1B, and a rear view of the laryngeal nerve exciter 10 is shown in FIG. 1C. The laryngeal nerve exciter 10 includes a bridge 12, an exciter 14, effector sleeves 16, end effectors 18, strap slots 20, and a strap 22. The exciter 14 is preferably a solenoid or a voice coil, or any device capable of generating vibrations at various frequencies, for example, vibrations between 30 and 200 Hz and preferably between 70 and 110 HZ and sufficiently strong to reach the laryngeal nerve for example, a pressure of 2-4 kpa or a vibration amplitude of 0.15 mm to 0.25 mm.

Figure 2:
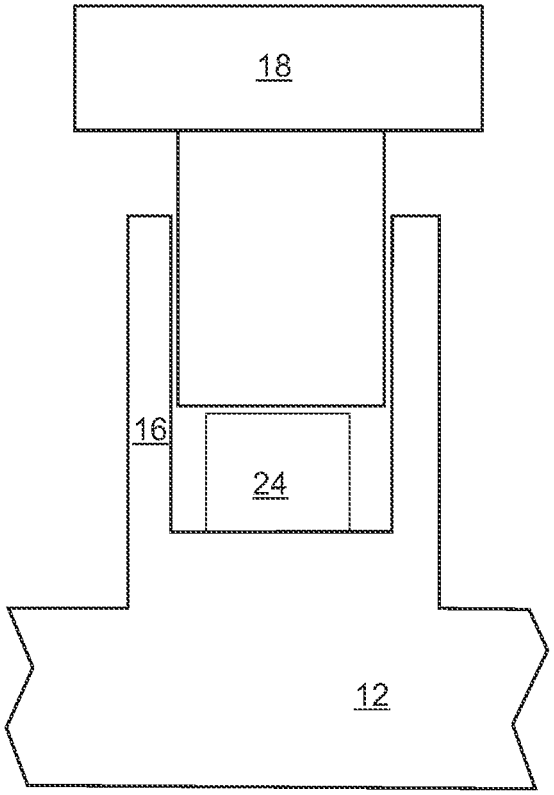
FIG. 2 shows an end effector of the laryngeal nerve exciter according to the present invention.

The end effector 18 of the laryngeal nerve exciter 10 is shown in FIG. 2. A force sensor 24 resides under each end effector 18 and provides force information to allow adjusting the tightness of the strap 22.

Figure 3:
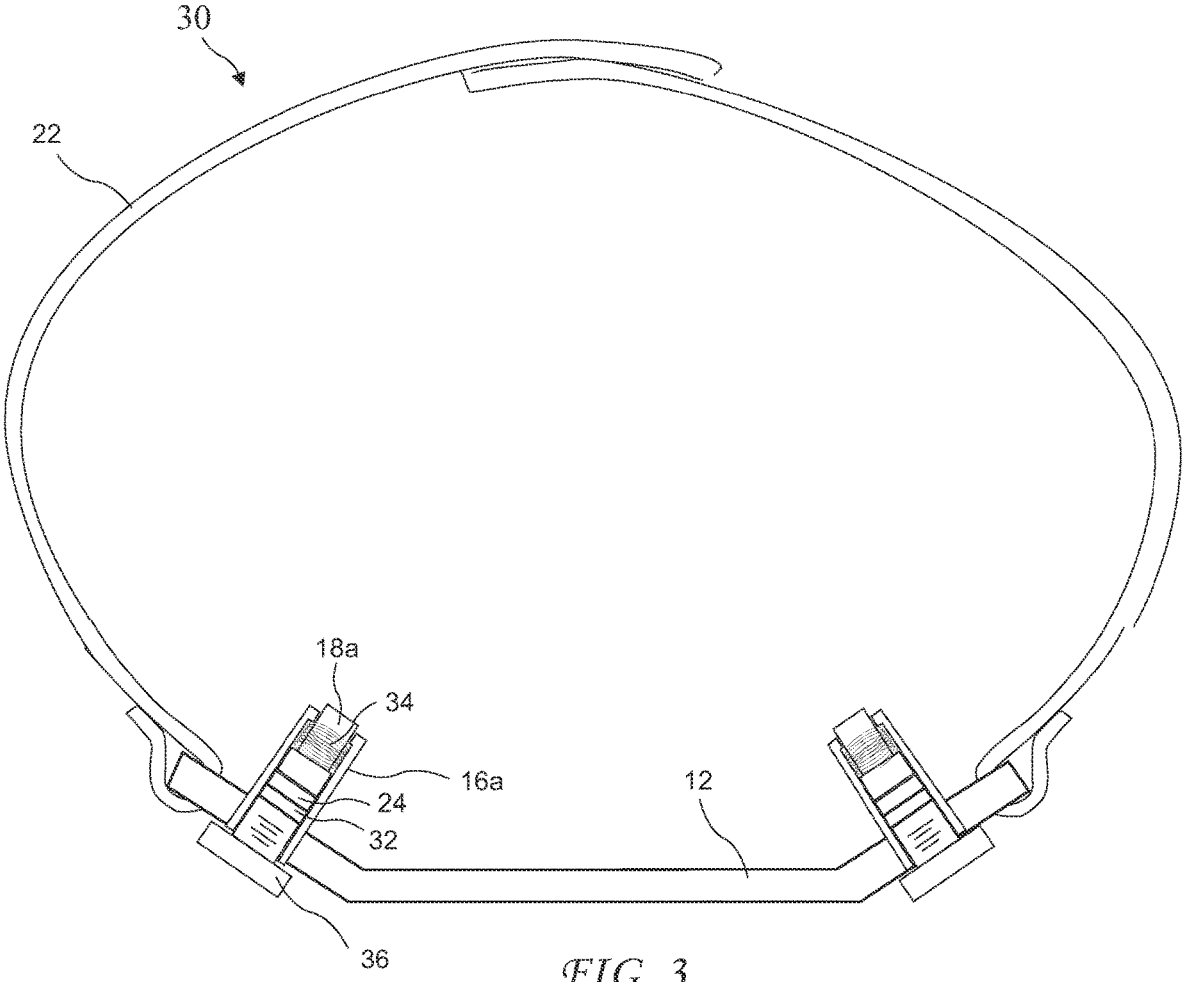
FIG. 3 shows a top view of a second embodiment of a laryngeal nerve exciter according to the present invention.

A top view of a second embodiment of a laryngeal nerve exciter 30 is shown in FIG. 3. The laryngeal nerve exciter 30 includes end effectors 18*a* held inside sleeves 16*a* and springs (or a resilient material) 34 holding the end effectors 18*a* against transducers 32. An adjust screw 36 presses the transducer 32 and end effector 18*a* against the spring 34 allowing adjustment of the end effectors 18*a* against the patient's neck without adjusting the strap 22. The transducers 32 may both vibrate the end effectors 18*a* to stimulate the laryngeal nerve and may sense a patient's attempt to swallow, and may sense stimulation by the other end effector 18*a*. The laryngeal nerve exciter 30 may include the force sensor 24 under the effector 16*a*. In another embodiment, the end effectors 18*a* may be fixedly attached to the moving part of the transducers 32 and no spring 34 is required.

Figure 4:
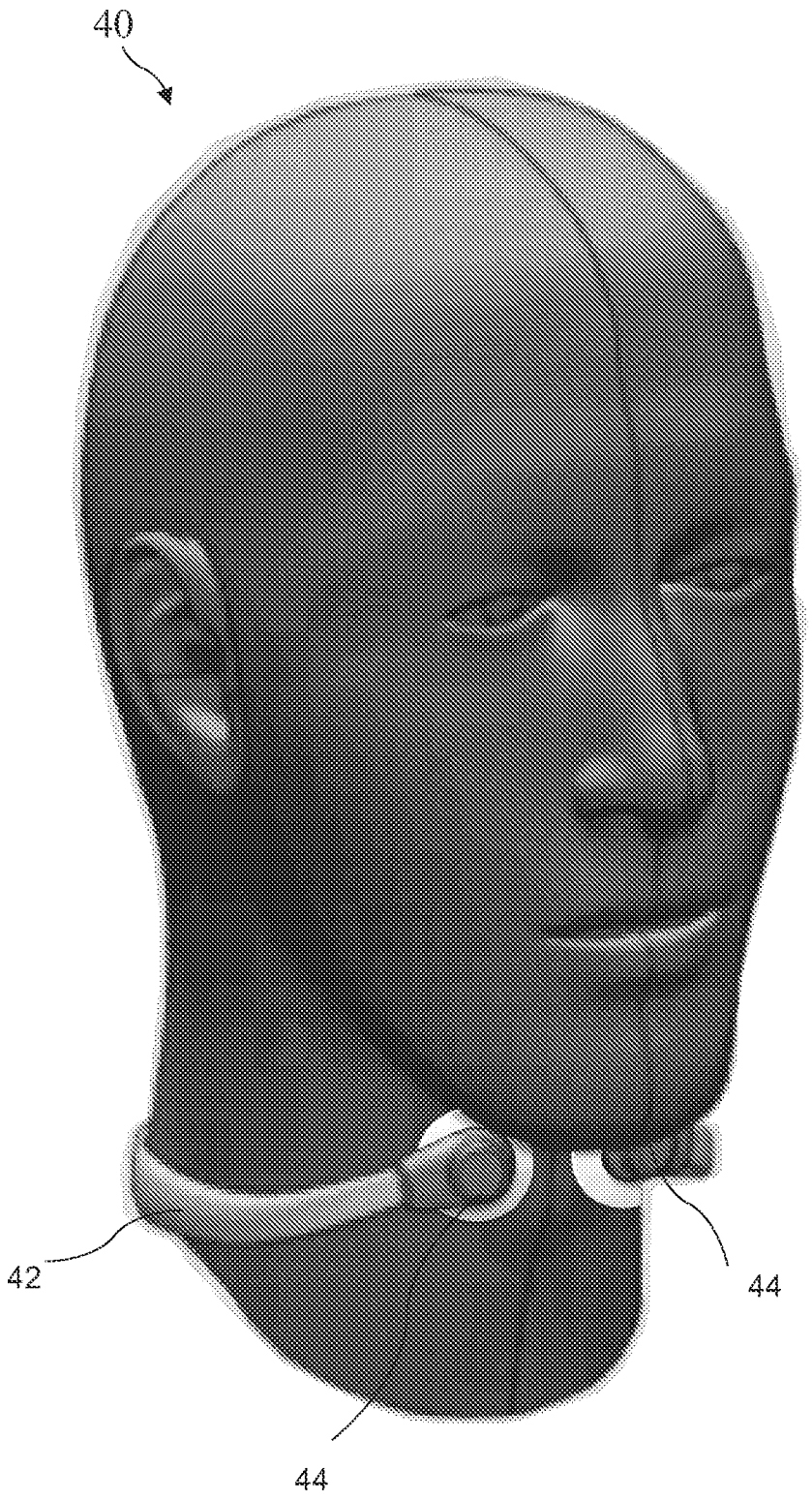
FIG. 4 shows a neckband laryngeal nerve exciter according to the present invention on a patent.

FIG. 4 shows a neckband laryngeal nerve exciter (neckband trainer) 42 on a patient 40. The neckband trainer 42 does not press against the patient's throat providing greater comfort for the patient. Two exciters 44 are pressed against sides of the neck. The exciters 44 preferably receive up to 10 Watts (five Watts per exciter). The neckband trainer 42 provides pressure to the area where the exciters 44 contact the neck. The force of the exciters 44 against the neck is measured and an alarm is generated if the force exceeds a threshold.

Figure 6:
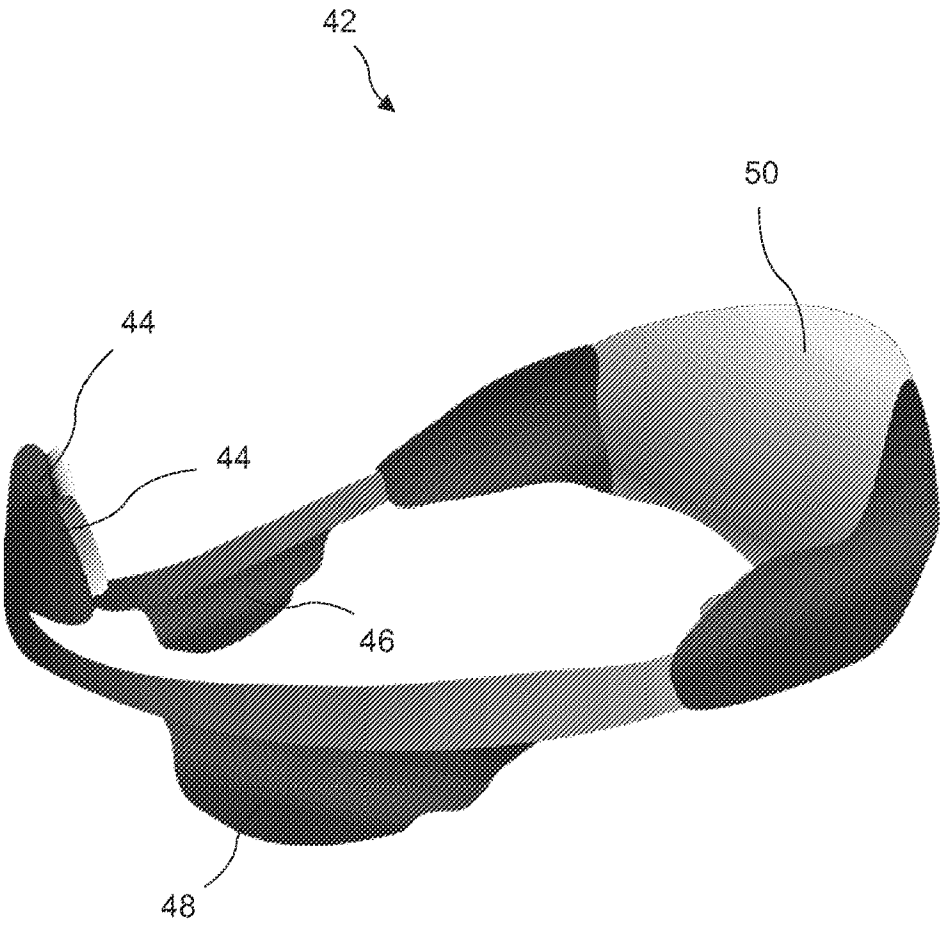
FIG. 6 shows a perspective view of the neckband laryngeal nerve exciter according to the present invention.
Figure 5:
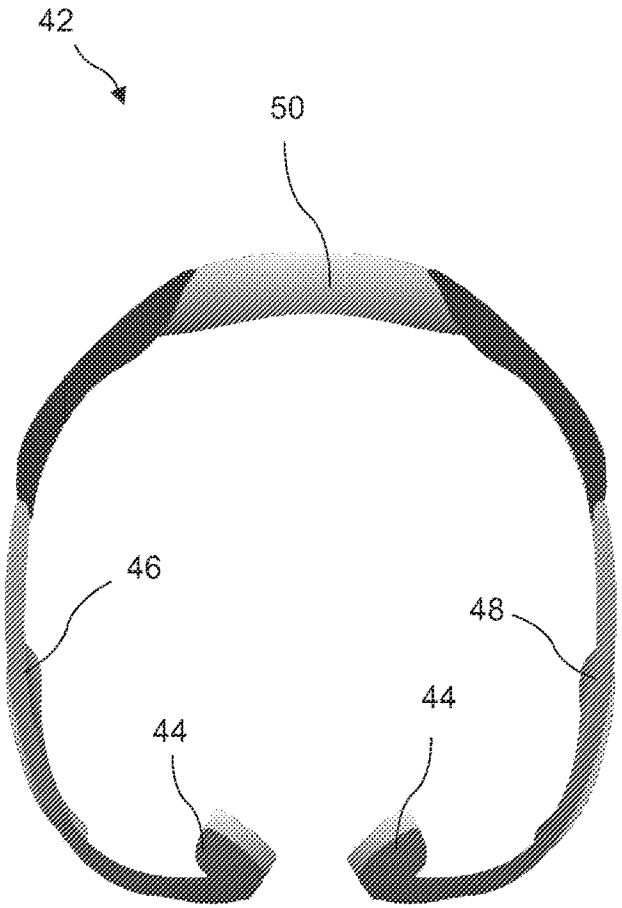
FIG. 5 shows a top view of the neckband laryngeal nerve exciter according to the present invention.

FIG. 5 shows a top view of the neckband trainer 42 and FIG. 6 shows a perspective view of the neckband trainer 42. The neckband trainer 42 includes the exciters 44, circuits 46 and 48, and a battery compartment 50. The neckband trainer 42 includes a charging port for charging batteries and is adjustable for individual patients.

Figure 7:
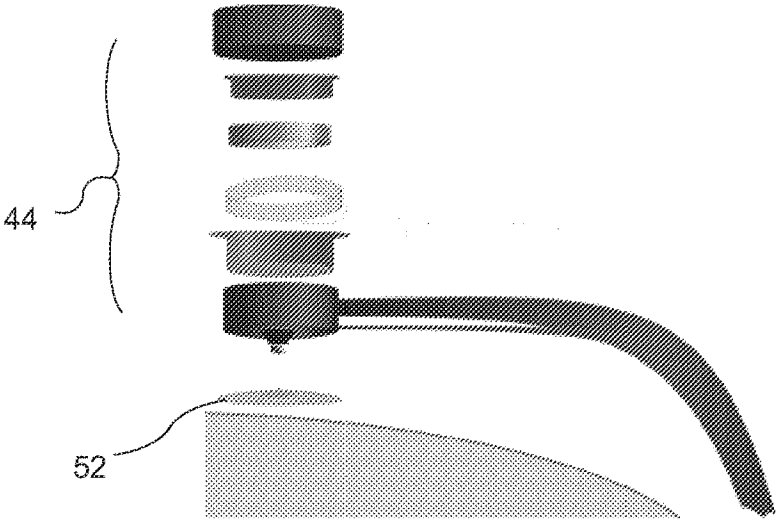
FIG. 7 shows a nerve exciter of the neckband laryngeal nerve exciter according to the present invention.

FIG. 7 shows a nerve exciter 44 of the neckband laryngeal nerve exciter.

Figure 8:
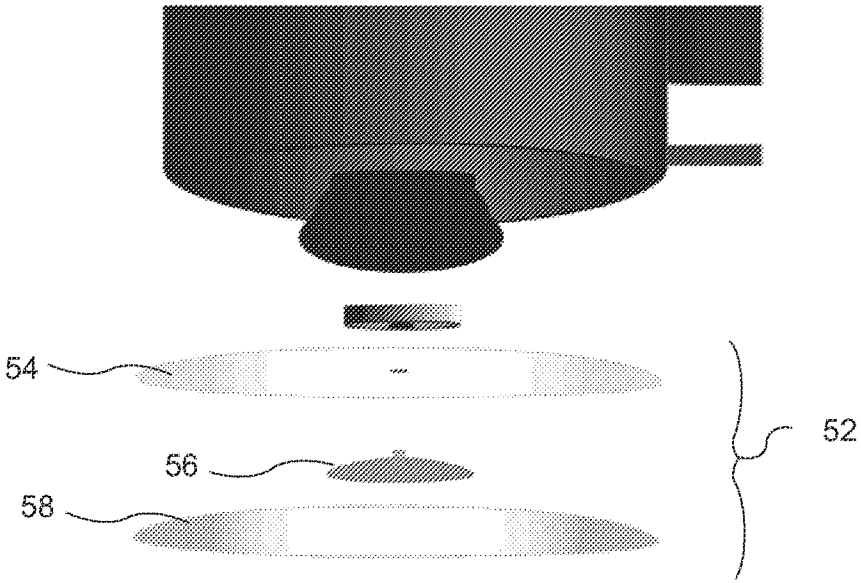
FIG. 8 shows an adhesive pad of the neckband laryngeal nerve exciter according to the present invention.

FIG. 8 shows an adhesive pad 52 of the neckband trainer 42. The adhesive pad 52 comprises a top adhesive pad 54, a plastic snap 56, and a bottom adhesive pad 58. The exciter 44 snaps onto the adhesive pad 52 to retain the exciter 44 against the patient's neck.

Figure 9:
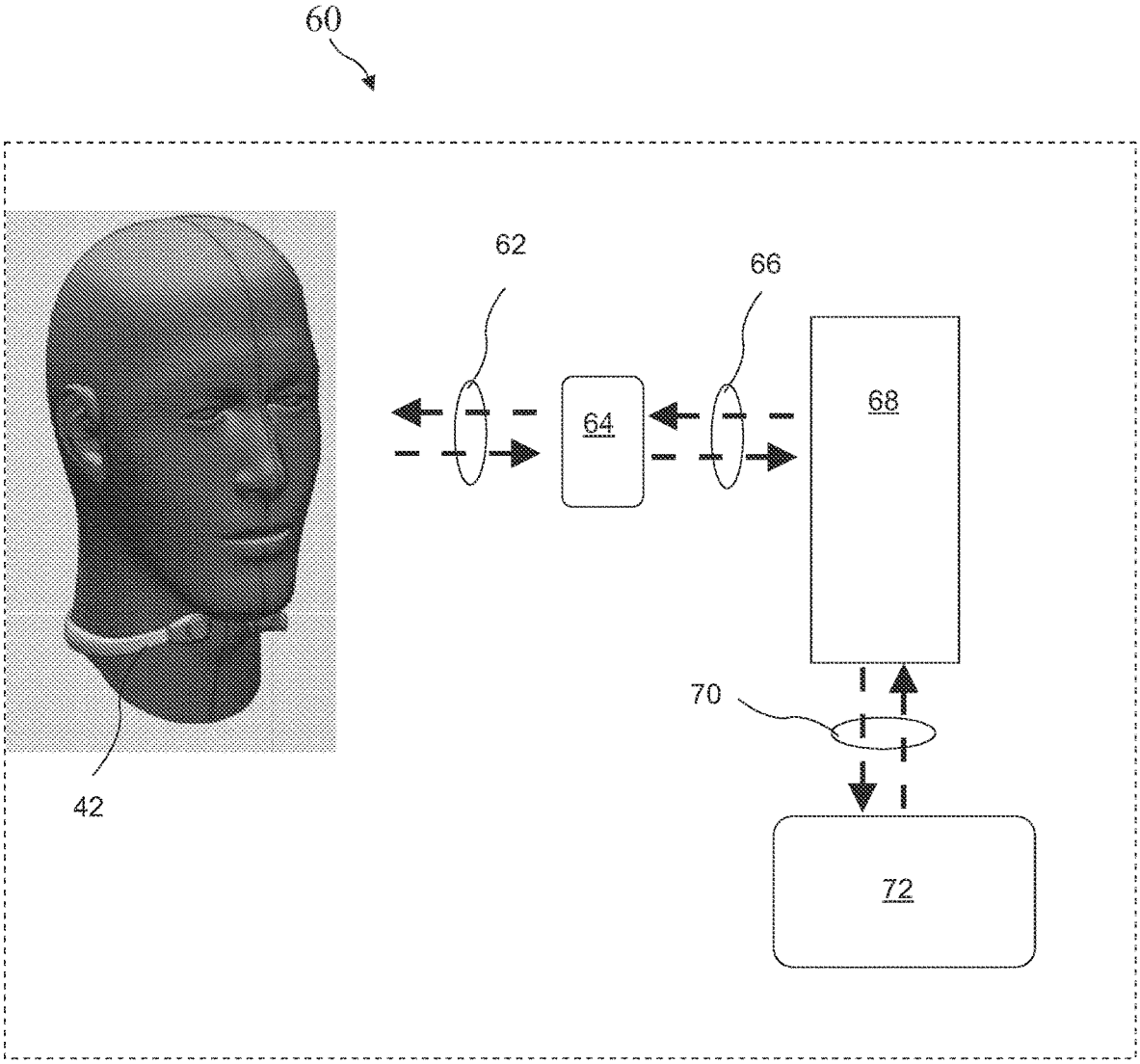
FIG. 9 shows a laryngeal nerve exciting system according to the present invention.

A laryngeal nerve exciter system 60 is shown in FIG. 9. The system 60 utilizes a software Application (App) residing in a Personal Digital Assistant (PDA) 64 which triggers, and monitors the neckband trainer 42 through a Bluetooth® interface 62. The interface 62 may include frequency, intensity, therapy time, vibration time, duration of rest period between vibration, and allows for patients to provide feedback about the therapy.

The PDA 64 may communicate with a secure server 68 through the Internet or any other suitable connection including wireless or wired connections 66 providing signals include frequency, intensity, therapy time, vibration time, duration of rest period between vibration, clinician calibration, and allows for patients to provide feedback about the therapy.

The secure server 68 may communicate with a work station 72 over the Internet or any other suitable connection including wireless or wired connections 70 providing signals include frequency, intensity, therapy time, vibration time, duration of rest period between vibration, and clinician calibration, and allows for patients to provide feedback about the therapy to the clinician.

The App may set the frequency of the neckband trainer 42, intensity, therapy time, vibration time, duration of rest period between vibration, and allows for patients to provide feedback about the therapy. Measurements made by the neckband trainer 42 (e.g., force measured by the exciters) may be provided to the PDA 46 via the Bluetooth® connection. Further, the system 60 may allow clinicians to monitor the patient's progress. The clinician will be able to see the device settings, frequency of the device, intensity, therapy time, vibration time, duration of rest period between vibration, number of uses, whether therapy was completed, and the patient feedback. A general state of health section for the patient may be provided to indicate how the patient is feeling before and after the therapy. The PDA 64 may be a smart phone.

While the invention herein disclosed has been described by means of specific embodiments and applications thereof, numerous modifications and variations could be made thereto by those skilled in the art without departing from the scope of the invention set forth in the claims.

What is claimed is:

1. A method of vibrationally exciting a laryngeal nerve to treat at least one of a swallow disorder, a voice disorder, or chronic cough, the method comprising:

providing a laryngeal nerve exciter system comprising:

a neckband, the neckband comprising a first free end and a second free end opposing each other to form an open front, the first free end and the second free end spaced apart by a distance, the neckband being flexible to accommodate necks of different sizes, the neckband further comprising a center portion facing the open front, a first side portion and a second side portion disposed on opposite sides of the center portion, a first exciter extending from the first free end of the neckband, the first exciter disposed between the first free end and the first side portion, the first exciter comprising a first surface coupled to the first free end of the neckband and a second surface opposing the first surface, a second exciter extending from the second free end of the neckband, the second exciter disposed between the second free end and the second side portion, the second exciter comprising a first surface coupled to the second free end of the neckband and a second surface opposing the first surface of the second exciter, and a first electrical circuit and a second electrical circuit configured to respectively control the first exciter and the second exciter, wherein each of the first side portion and the second side portion comprises a first region and a second region closer to the center portion than the first region, wherein each first region comprises a housing mounted thereon and respectively accommodating the first electrical circuit or the second electrical circuit, and wherein each first region is larger in size than each second region due to the housing;

coupling a first adhesive pad and a second adhesive pad respectively to the first exciter and the second exciter, each of the first adhesive pad and the second adhesive pad comprising a first surface coupled to the second surface of the corresponding first exciter or the second exciter and a second surface opposing the first surface of the corresponding adhesive pad, the second surfaces of the first adhesive pad and the second adhesive pad being adhesive;

widening the distance between the first free end and the second free end of the neckband;

placing the neckband at least partially around a neck of a patient such that:

the center portion of the neckband is placed on a rear portion of the neck while the distance is widened to a first distance, and the first free end, the second free end, and the open front of the neckband face a front portion of the neck of the patient while the first distance is narrowed to a second distance less than the first distance;

moving the neckband such that:

the first adhesive pad and the second adhesive pad are respectively positioned against a first portion and a second portion of the patient's neck different from each other;

the open front of the neckband exposes the patient's throat; and the second surfaces of the first adhesive pad and the second adhesive pad fix positions of the neckband by adhering to the patient's skin; and vibrationally exciting the laryngeal nerve of the patient to treat at least one of the swallow disorder, the voice disorder, or chronic cough, the vibrationally exciting including generating vibration, by the first exciter and the second exciter, and conducting, by the first exciter and the second exciter, the generated vibration to the patient's neck.

2. The method of claim 1, wherein the neckband further comprises a battery compartment disposed at the center portion of the neckband and configured to accommodate a battery.

3. The method of claim 2, wherein the distance between the first free end and the second free end is less than a length of the battery compartment.

4. The method of claim 2, wherein at least one of the first free end, the second free end, or the open front faces the battery compartment.

5. The method of claim 2, wherein the battery compartment is thicker than each of the first side portion and the second side portion of the neckband.

6. The method of claim 5, wherein the first free end and the second free end are respectively coupled to the first side portion and the second side portion in a curved manner having a first curvature.

7. The method of claim 6, wherein the first exciter and the second exciter are respectively coupled to the first free end and the second free end in a direction extending the first curvature.

8. The method of claim 5, wherein the center portion is coupled to the first side portion and the second side portion in a curved manner having a second curvature different from the first curvature.

9. The method of claim 8, wherein a radius of the first curvature is smaller than a radius of the second curvature.

10. The method of claim 1, wherein at least one of a length of the first side portion or a length of the second side portion is fixed.

11. The method of claim 1, wherein at least one of a length of the first side portion or a length of the second side portion is adjustable.

12. The method of claim 1, further comprising:

measuring, by first and second force sensors, force of the first exciter and the second exciter against the first and second portions of the patient's neck; and generating an alarm in response to the measured force exceeding a threshold.

13. A method of vibrationally exciting a laryngeal nerve to treat at least one of a swallow disorder, a voice disorder, or chronic cough, the method comprising:

providing a laryngeal nerve exciter system comprising:

a neckband, the neckband comprising a first free end and a second free end opposing each other to form an open front, the first free end and the second free end spaced apart by a distance, the neckband being flexible to accommodate necks of different sizes, the neckband further comprising a center portion facing the open front, a first side portion and a second side portion disposed on opposite sides of the center portion, a first exciter extending from the first free end of the neckband, the first exciter disposed between the first free end and the first side portion, the first exciter comprising a first surface coupled to the first free end of the neckband and a second surface opposing the first surface, a second exciter extending from the second free end of the neckband, the second exciter disposed between the second free end and the second side portion, the second exciter comprising a first surface coupled to the second free end of the neckband and a second surface opposing the first surface of the second exciter, and a first electrical circuit and a second electrical circuit configured to respectively control the first exciter and the second exciter, wherein each of the first side portion and the second side portion comprises a first region and a second region closer to the center portion than the first region, wherein each first region comprises a housing mounted thereon and respectively accommodating the first electrical circuit or the second electrical circuit, and wherein each first region is larger in size than each second region due to the housing;

coupling a first adhesive pad and a second adhesive pad respectively to the first exciter and the second exciter, each of the first adhesive pad and the second adhesive pad comprising a first surface coupled to the second surface of the first exciter or the second exciter and a second surface opposing the first surface of each adhesive pad, the second surfaces of the first adhesive pad and the second adhesive pad being adhesive;

placing the neckband at least partially around a neck of a patient;

moving the neckband such that the first adhesive pad and the second adhesive pad are respectively positioned against a first portion and a second portion of the patient's neck different from each other and the open front of the neckband exposes the patient's throat and the second surfaces of the first adhesive pad and the second adhesive pad fix positions of the neckband by adhering to the patient's skin; and vibrationally exciting the laryngeal nerve of the patient to treat at least one of the swallow disorder, the voice disorder, or chronic cough, the vibrationally exciting including generating vibration, by the first exciter and the second exciter, and conducting, by the first exciter and the second exciter, the generated vibration to the patient's neck.

* * * * *